US009162487B2

(12) United States Patent
Imamura

(10) Patent No.: US 9,162,487 B2
(45) Date of Patent: Oct. 20, 2015

(54) IMAGE RECORDING DEVICE AND IMAGE RECORDING METHOD

(71) Applicant: SEIKO EPSON CORPORATION, Tokyo (JP)

(72) Inventor: Atsushi Imamura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/572,577

(22) Filed: Dec. 16, 2014

(65) Prior Publication Data

US 2015/0103124 A1 Apr. 16, 2015

Related U.S. Application Data

(63) Continuation of application No. 14/153,952, filed on Jan. 13, 2014, now Pat. No. 8,960,850.

(30) Foreign Application Priority Data

Jan. 16, 2013 (JP) ..... 2013-005187

(51) Int. Cl.

| | |
|---|---|
| ***B41J 2/01*** | (2006.01) |
| ***B41J 11/00*** | (2006.01) |
| ***B41J 15/00*** | (2006.01) |
| ***B41J 15/04*** | (2006.01) |

(52) U.S. Cl.

CPC ..... *B41J 11/002* (2013.01); *B41J 11/006* (2013.01); *B41J 11/0095* (2013.01); *B41J 15/00* (2013.01); *B41J 15/04* (2013.01)

(58) Field of Classification Search

CPC ..... B41J 11/002; B41J 11/0095; B41J 15/04

See application file for complete search history.

(56) References Cited

FOREIGN PATENT DOCUMENTS

| | | |
|---|---|---|
| JP | 10-086472 | 4/1998 |
| JP | 2005-014222 | 1/2005 |
| JP | 2006-088454 | 4/2006 |
| JP | 2010-284976 | 12/2010 |

OTHER PUBLICATIONS

U.S. Appl. No. 14/153,952, Oct. 10, 2014, Notice of Allowance.

*Primary Examiner* — Julian Huffman

(74) *Attorney, Agent, or Firm* — Workman Nydegger

(57) ABSTRACT

An arrival of a joint member at a detection position provided at an upstream side of a recording unit on a transportation path is detected. A second distance, which is a distance from the detection position to the recording head along the transportation path, is longer than a first distance, which is a distance of a transportation of the continuous medium in the case where, because of an existence of a liquid already landed on an area of the continuous medium at the detection time, the area being located at a position being on the transportation path and facing the recording unit, the continuous medium is transported during a period until at least hardening of the liquid is completed by a light radiation portion.

4 Claims, 8 Drawing Sheets

IMAGE RECORDING DEVICE AND IMAGE RECORDING METHOD

CROSS-REFERENCE TO RELATED APPLICATIONS

This application is a continuation application of U.S. patent application Ser. No. 14/153,952, filed Jan. 13, 2014, which patent application is incorporated herein by reference in its entirety. U.S. patent application Ser. No. 14/153,952 claims the benefit of and priority to Japanese Patent Application No. 2013-005187 filed Jan. 16, 2013, the contents of which are hereby incorporated by reference in its entirety.

BACKGROUND

1. Technical Field

The present invention relates to an image recording technology for recording an image by ejecting a photocurable liquid from a recording head onto a continuous medium, which is formed by means of jointing a plurality of media with joint members, and hardening the image by means of light radiation.

2. Related Art

In JP-A-10-86472, there is disclosed an image recording device which is provided with a printing portion facing a transportation drum and performs printing of an image by ejecting liquids (inks) from the printing portion onto a medium which is wound and hung on the transportation drum. In particular, this image recording device makes it possible to continuously record a plurality of images which is arranged on a long-length continuous medium (so-called continuous paper) by transporting the continuous medium towards the transportation drum and, simultaneously therewith, causing the printing portion to record the images in series.

Meanwhile, the use of a photocurable liquid, which becomes hardened by being irradiated with light, enables improvement of the adherability of images to a continuous medium. Specifically, there are provided a recording head for ejecting a photocurable liquid onto a continuous medium in the state of being transported along a transportation path, and a light radiation portion for irradiating the continuous medium with light at a downstream side of the recording head on the transportation path, and through hardening of images having been recorded by the recording head by means of light radiation from the light radiation portion, it is possible to allow the images to firmly adhere to the recording medium. Nevertheless, there have been disadvantages described below when applying such a technology to an image recording device for recording images on a continuous medium.

That is, sometimes, a continuous medium is formed by means of jointing a plurality of media with joint members, such as pieces of tape. When such a continuous medium is employed, in order to avoid a damage of, for example, a recording head because of a contact of the recording head with a continuous medium's portion whose thickness is increased because of the provision of the joint member, it is preferred to bring the transportation of the continuous medium to a stop once before the joint member reaches the recording head. Specifically, the transportation of the continuous medium should be brought to a stop by detecting an event that the joint member has reached a detection position which is provided before the recording head. Nevertheless, bringing the transportation of the continuous medium to a stop before images, which are already recorded by the recording head, reach the light radiation portion results in occurrence of a situation where un-hardened images are left as they are, and thus, is likely to cause another disadvantage in that other component members are soiled by the un-hardened images.

SUMMARY

An advantage of some aspects of the invention is to, in an image recording technology for recording images by ejecting a photocurable liquid from a recording head onto a continuous medium which is formed by means of jointing a plurality of media with joint members and hardening the imaged by irradiating the photocurable liquid with light, provide a technology which enables prevention of two situations, one being that a portion where a joint member is provided is contacted with a recording head, the other one being that un-hardened images are left as they are.

An image recording device according to a first aspect of the inventing includes a transportation portion that transports a continuous medium along a transportation path, the continuous medium being formed by means of jointing a plurality of media with at least one joint member; a recording unit that includes a recording head facing the transportation path, and carries out recording operation of recording an image on the continuous medium by ejecting a photocurable liquid from the recording unit onto the continuous medium in a state of being transported along the transportation path; a light radiation portion that is arranged at a downstream side of the recording unit on the transportation path and hardens the liquid which is ejected on the continuous medium; a position detection portion that detects an arrival of each of the at least one joint member at a detection position which is located at an upstream side of the recording unit on the transportation path; and a controller that performs control of the recording unit and the transportation portion on the basis of a result of a detection made by the position detection portion so as to bring the recording operation to a halt after a detection time point at which the position detection portion detects an arrival of each of the at least one joint member at the detection position, and bring a transportation of the continuous medium to a stop at a transportation stop time point after a transportation of the continuous medium during a period until at least hardening of a liquid already ejected on the continuous medium at a halt time point of the recording operation is completed, and the position detection portion, the recording head and the light radiation portion are arranged along the transportation path such that a second distance, which is a distance from the detection position to the recording head along the transportation path, becomes longer than a first distance, which is a distance of a transportation of the continuous medium in the case where, because of an existence of a liquid already landed on an area of the continuous medium at the detection time point, the area being located at a position which is on the transportation path and faces the recording unit, the continuous medium is transported during a period until at least hardening of the liquid is completed by the light radiation portion.

In the first aspect of the invention (the image recording device) configured in such a way as described, the recording unit including the recording head which faces the transportation path and ejects a photocurable liquid is used. Specifically, the recording operation for recording the image on the continuous medium by ejecting the photocurable liquid from the recording head onto the continuous medium in the state of being transported along the transportation path is performed by using the recording unit. The light radiation portion is provided at a downstream side of the recording unit on the transportation path, and liquid which is ejected onto the continuous medium becomes hardened by being irradiated with light from the light radiation portion. In this way, the image is firmly adhered to the recording medium.

The detection position at which the joint member is detected is provided at an upstream side of the recording unit on the transportation path, and when it has been detected that the joint member has reached the detection position, the recording operation is brought to a halt. Meanwhile, the transportation of the continuous medium is continuously performed for a while, and at least hardening of a liquid already ejected on the continuous medium at the halt time point of the recording operation is completed by the light radiation portion. This makes it possible to prevent that un-hardened images are left as they are after the halt of the transportation of the continuous medium, and other component members are soiled thereby.

In this regard, however, since the transportation of the continuous medium is continuously performed even after the joint member has reached the detection position, a portion of the continuous medium at which the joint member is provided moves in conjunction with the transportation of the continuous medium, and is likely to be contacted with the recording head. In this regard, in the first aspect of the invention, the position detection portion, the recording head and the light radiation portion are arranged along the transportation path such that the second distance, which is a distance from the detection position to the recording head along the transportation path, becomes longer than the first distance, which is a distance of a transportation of the continuous medium in the case where, because of an existence of a liquid already landed on an area of the continuous medium at the detection time point, the area being located at a position which is located on the transportation path and faces the recording unit, the continuous medium is transported during a period until at least hardening of the liquid is completed by the light radiation portion. Thus, it is possible to complete the operation of bringing the transportation of the continuous medium to a stop after the completion of hardening of the liquid which is already ejected on the continuous medium, so that it is prevented that the portion where the joint member is provided is contacted with the recording head. In this way, in the first aspect of the invention, it is possible to prevent both the disadvantages, one being that the portion where the joint member is provided is contacted with the recording head, the other one being that un-hardened images are left as they are.

Incidentally, with respect to a time point at which recording operation is brought to a halt, various methods can be considered. The image recording device may be configured such that the controller brings the recording operation to a halt simultaneously with the detection time point. Alternatively, the image recording device may be configured such that the controller sets the halt time point of the recording operation so as to make the second distance longer than a third distance which is a distance of a transportation of the continuous medium during a period from the detection time point until the transportation stop time point.

In this case, the image recording device may be configured such that the recording unit sequentially records a plurality of the images arranged along the transportation path in the recording operation, and the controller is configured to, when, at the detection time point, there exists at least one of the images which is process of being recorded, determine whether or not, when the recording operation is brought to a stop after a completion of recording of the at least one image in process of being recorded, the second distance is longer than the third distance; in the case where a result of the determination is that the second distance is longer than the third distance, bring the recording operation to a stop after the completion of recording of the at least image in process of being recorded; and in the case where a result of the determination is that the second distance is shorter than or equal to the third distance, bring the recording operation to a stop before the halt time point of the recording operation in the case where the third distance becomes equal to the second distance. This configuration enables prevention of formation of incomplete images on the continuous medium, and thus, leads to an advantage in that wasteful consumption of the continuous medium because of the incomplete images can be suppressed.

Further, the image recording device may be configured such that the image recording device further includes a thickness detection portion for detecting a thickness of the joint member, and the controller performs control of resumption of the recording operation after the transportation halt time point on the basis of a result of a prediction, from a result of a detection made by the thickness detection portion, as to whether or not, when one of the at least one joint member passes below the recording head along the transportation path, there occurs a contact between the portion where the one of the at least one joint member is provided and the recording head. This configuration enables resumption of the recording operation in a suitable way in accordance with the width of the joint member.

Specifically, the image recording device may be configured such that, in the case where the result of the prediction is that there occurs no contact between the portion where the one of the at least one joint member is provided and the recording head, the controller resumes the recording operation from a state where the one of the at least one joint member exists at an upstream side of the recording unit on the transportation path. In this case, the image recording device may be configured such that the controller resumes the recording operation after a completion of a transportation of the continuous medium towards an upstream side on the transportation path by a backward transportation distance larger than or equal to a distance of a transportation of the continuous medium during a period from the halt time point of the recording operation until the transportation stop time point. This configuration keeps a distance between the images which are already formed on the continuous medium and images to be formed in resumed printing operation to a small distance, and thus, leads to an advantage in that wasteful consumption of the continuous medium can be suppressed.

Further, the image recording device may be configured such that the recording unit is configured so as to come close to or spaced from the transportation path, and ejects a liquid onto the continuous medium by being located close to the transportation path, and is evacuated from each of the at least one joint member and the continuous medium which pass on the transportation path by being located spaced from the transportation path, and in the case where the result of the prediction is that there occurs a contact between the portion where the one of the at least one joint member is provided and the recording head, the controller resumes the recording operation after a completion of shifting of the one of the at least one joint member from an upstream side of the printing head to a downstream side of the printing head on the transportation path subsequent to causing the recording unit to be located spaced from the transportation path. This configuration makes it possible to prevent that the portion where the joint member is provided is contacted with the recording head and, simultaneously therewith, resume the printing operation.

An image recording method according to a second aspect of the invention includes performing recording operation of recording an image on a continuous medium in a state of being transported along a transportation path by using a recording unit including a recording head which faces the transportation path and ejects a photocurable liquid, the continuous medium being formed by means of jointing a plurality of media with at least one joint member; hardening a liquid which is ejected on the continuous medium by irradiating the liquid with light from a light radiation portion which is provided at a downstream side of the recording unit on the transportation path; detecting an arrival of each of the at least one joint member at a detection position which is provided at an upstream side of the recording unit on the transportation path; bringing the recording operation to a halt after a detection time point at which an arrive of each of the at least one joint member at the detection position is detected; and bringing a transportation of the continuous medium to a stop at a transportation stop time point after a transportation of the continuous medium during a period until at least hardening of a liquid already ejected on the continuous medium at a halt time point of the recording operation is completed, wherein the position detection portion, the recording head and the light radiation portion are arranged along the transportation path such that a second distance, which is a distance from the detection position to the recording head along the transportation path, becomes longer than a first distance, which is a distance of a transportation of the continuous medium in the case where, because of an existence of a liquid already landed on an area of the continuous medium at the detection time point, the area being located at a position which is on the transportation path and faces the recording unit, the continuous medium is transported during a period until at least hardening of the liquid is completed by the light radiation portion, and the halt time point of the recording operation is set so as to make the second distance longer than a third distance which is a distance of a transportation of the continuous medium during a period from the detection time point until the transportation stop time point.

In the second aspect of the invention (the image recording method) configured in such a way as described above, the detection position, the recording head and the light radiation portion are arranged along the transportation path such that the second distance, which is a distance from the detection position to the recording head along the transportation path, becomes longer than the first distance, which is a distance of a transportation of the continuous medium in the case where, because of an existence of a liquid already landed on an area of the continuous medium at the detection time point, the area being located at a position which is on the transportation path and faces the recording unit, the continuous medium is transported during a period until at least hardening of the liquid is completed by the light radiation portion. Thus, it is possible to complete the operation of bringing the transportation of the continuous medium to a stop after the completion of hardening of the liquid which is already ejected on the continuous medium, so that it is prevented that the portion where the joint member is provided is contacted with the recording head. In this way, in the second aspect of the invention, it is possible to prevent both the disadvantages, one being that the portion where the joint member is provided is contacted with the recording head, the other one being that un-hardened images are left as they are.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
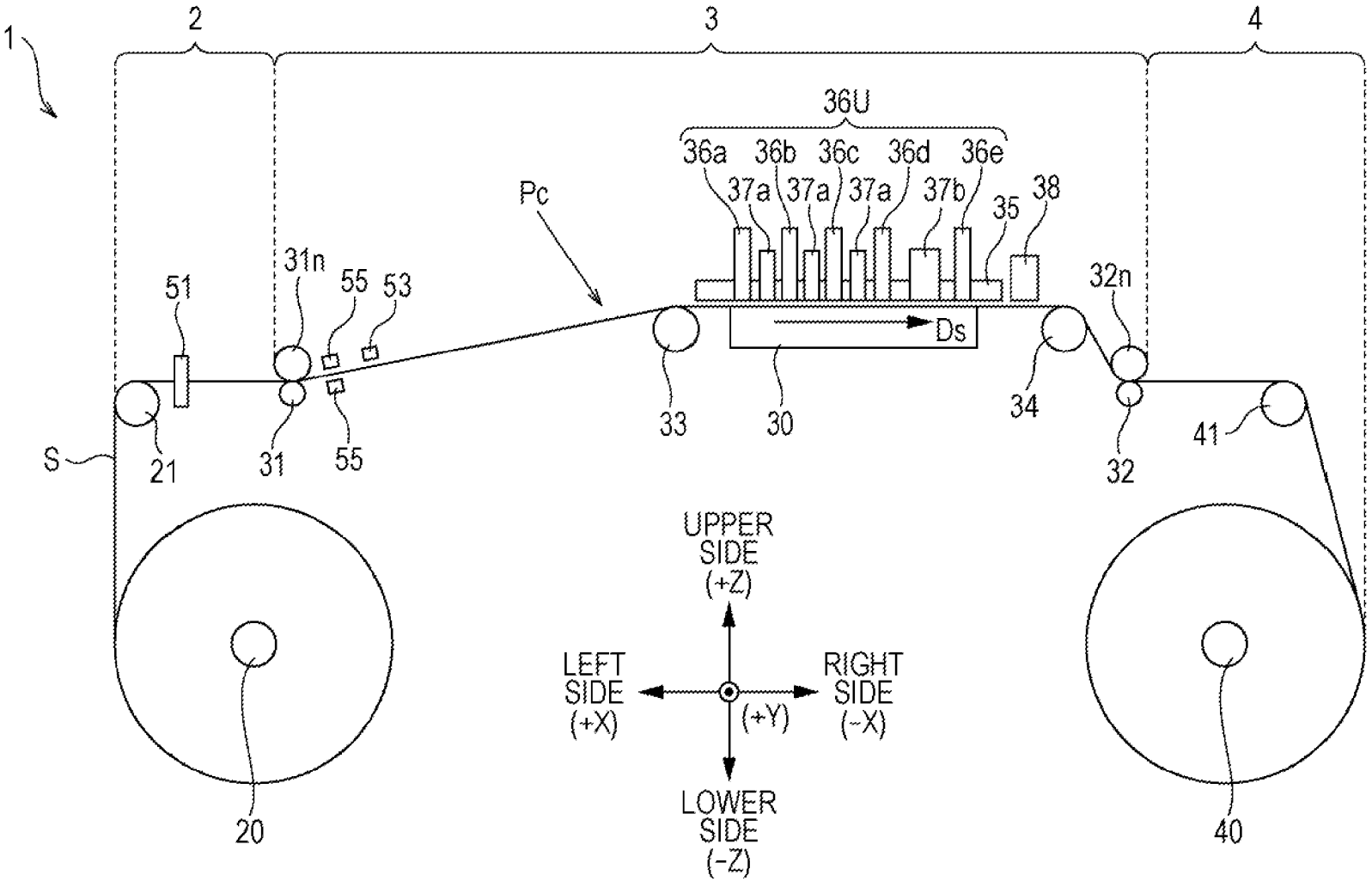
FIG. 1 is a schematic front view illustrating a configuration of a printer to which the invention can be applied.

Hereinafter, a configuration of a printer to which the aspect of the invention can be applied will be described with reference to the drawings. FIG. 1 is a schematic front view illustrating a configuration of a printer to which the aspect of the invention can be applied. In addition, in FIG. 1 and drawings described blow, in order to specifically describe location relations among individual portions included in a printer 1, a three dimensional coordinate system corresponding to a left and right direction X, a front and rear direction Y and a vertical direction Z with respect to the printer 1 is employed as needed.

As shown in FIG. 1, in the printer 1, an unreeling portion 2, a processing portion 3 and a reeling portion 4 are arranged in the left and right direction. The unreeling portion 2 and the reeling portion 4 include an unreeling shaft 20 and a reeling shaft 40, respectively. Further, a sheet S (a web), both edge portions thereof each being wound in a roll state around a corresponding one of the unreeling shaft 20 and the reeling shaft 40, is extended therebetween. The sheet S extended in this way is transported from the unreeling shaft 20 to the processing portion 3 along a transportation path Pc. Further, the sheet S is subjected to image recording processing performed by a printing unit 36U in the processing portion 3, and then, is transported to the reeling portion 40.

The sheet S corresponds to the "continuous medium" according to the aspect of the invention, and is formed into a long-length object by means of jointing a plurality of media with pieces of joint tape each corresponding to the "joint member" according to the aspect of the invention. Kinds of this sheet S are roughly classified into a kind of sheet based on paper and a kind of sheet based on film. Specific examples of this kind of sheet based on paper include high-quality paper, cast paper, art paper, coated paper and the like; while specific examples of this kind of sheet based on film include synthetic paper, polyethylene terephthalate (PET), polypropylene (PP) and the like. In addition, in the following description, for two faces of the sheet S, a face on which an image is recorded will be referred to as an obverse face; while its dorsal face will be referred to as a reverse face.

The unreeling portion 2 includes the unreeling shaft 20 around which the edge portion of the sheet S is wound, as well as a driven roller 21 on which the sheet S pulled out from the unreeling shaft 20 is wound and hung. The unreeling shaft 20 supports the sheet S under the state where an edge portion of the sheet S is wound around itself and the obverse face of the sheet S faces in an outward direction from itself. Further, the rotation of the unreeling shaft 20 in the clockwise direction on the surface of FIG. 1 causes the sheet S wound around the unreeling shaft 20 to be unreeled to the processing portion 3 via the driven roller 21.

The processing portion 3 is a portion for recording images on the sheet S by causing a flat-type platen 30 whose surface is formed so as to be planar to support the sheet S having been unreeled from the unreeling portion 2, and causing the printing unit 36U, which is arranged along the surface of the platen 30, to appropriately eject inks onto the sheet S. In this processing unit 3, an anterior driving roller 31 and a posterior driving roller 32 are provided at both outsides of the platen 30, and the sheet S in the state of being transported from the anterior driving roller 31 to the posterior driving roller 32 is subjected to image printing processing while being supported by the platen 30.

The platen 30 is held by a holding mechanism omitted from illustration such that its face (its upper face) supporting the sheet S is made horizontal. A driven roller 33 and a driven roller 34 are provided at the left outside and the right outside of the platen 30, respectively, and the sheet S in the state of being transported from the anterior driving roller 31 to the posterior driving roller 32 is wound and hung on each of the driven rollers 33 and 34 such that the reverse face of sheet S faces the outer circumference face of each of the driven rollers 33 and 34. The driven rollers 33 and 34 are arranged so as to allow their upper positions to be vertically aligned with or slightly below the position of the surface of the platen 30 in order to keep a state in which the sheet S in the state of being transported from the anterior driving roller 31 to the posterior driving roller 32 comes in contact with the platen 30.

The anterior driving roller 31 includes a plurality of very little protrusions, which are formed by means of spray forming, on its outer circumference face, and this outer circumference face thereof is contacted with the reverse face of the sheet S having been unreeled from the unreeling portion 2. Further, the rotation of the anterior driving roller 31 in the clockwise direction on the surface of FIG. 1 transports the sheet S having been unreeled from the unreeling portion 2 to the platen 30 via the driven roller 33. In addition, the anterior driving roller 31 is provided with a nip roller 31*n*. This nip roller 31*n* comes in contact with the obverse face of the sheet S under the state where the nip roller 31*n* is biased towards the anterior driving roller 31, and pinches the sheet S between the anterior driving roller 31 and itself. This configuration ensures frictional force between the anterior driving roller 31 and the sheet S, and thus enables the anterior driving roller 31 to certainly perform the transportation of the sheet S.

The posterior driving roller 32 includes a plurality of very little protrusions, which are formed by means of spray forming, at its outer circumference face, and this outer circumference face is contacted with the reverse face of the sheet S having been transported from the platen 30 via the driven roller 34. Further, the rotation of the posterior driving roller 32 in the clockwise direction on the surface of FIG. 1 transports the sheet S to the reeling portion 4. In addition, the posterior driving roller 32 is provided with a nip roller 32*n*. This nip roller 32*n* comes in contacted with the obverse face of the sheet S under the state where the nip roller 32*n* is biased towards the posterior driving roller 32, and pinches the sheet S between the posterior driving roller 32 and itself. This configuration ensures frictional force between the posterior driving roller 32 and the sheet S, and thus enables the posterior driving roller 32 to certainly perform the transportation of the sheet S.

In this way, the sheet S in the state of being transported from the anterior driving roller 31 to the posterior driving roller 32 is transported on the platen 30 in a transportation direction Ds while being supported by the platen 30. Further, in the processing portion 3, in order to perform printing of color images on the obverse face of the sheet S supported by the platen 30, four printing heads 36*a* to 36*d* are arranged in the transportation direction Ds so as to face the surface of the platen 30. The printing heads 36*a*, 36*b*, 36*c* and 36*d* correspond to colors yellow, cyan, magenta and black, respectively, and each of the printing heads 36*a*, 36*b*, 36*c* and 36*d* ejects a corresponding one of the colors through a corresponding nozzle whose opening faces the surface of the platen 30. Specifically, in each of the printing heads 36*a* to 36*d*, a plurality of the nozzles are arranged in a straight line in the Y direction perpendicular to the transportation direction Ds so as to form a nozzle row, and further, a plurality of the nozzle rows (for example, two nozzle rows) are arranged in the transportation direction Ds such that every adjacent ones of the nozzle rows are spaced from each other. Thus, each of the printing heads 36*a* to 36*d* is capable of simultaneously performing printing of images per line with respect to a plurality of lines.

The printing heads 36*a* to 36*d* are each configured so as to come close to or spaced from the platen 30. Each of the printing heads 36*a* to 36*d* in the state of being close to the platen 30 faces the obverse face of the sheet S being supported by the platen 30 so as to be spaced from the obverse face of the sheet S by a slight clearance for printing, and ejects an ink of a corresponding color by means of an ink jet method. Further, through the ink ejections of the printing heads 36*a* to 36*d* onto the sheet S in the state of being transported along the transportation direction Ds, color images are formed on the obverse face of the sheet S. Meanwhile, each of the printing heads 36*a* to 36*d* in the state of being separate from the platen 30 faces the obverse face of the sheet S being supported by the platen 30 so as to be spaced from the obverse face of the sheet S by a clearance for evacuation, the amount of which is larger than that of the clearance for printing, and thus, can be evacuated from the sheet S to which a foreign object is adhered, a foreign object or the like which passes above the platen 30 along the transportation path Pc.

Incidentally, with respect to a kind of ink, an ultraviolet (UV) ink (a photocurable ink) which becomes hardened by been irradiated with ultraviolet light rays (light rays) is used. Thus, in order to cause an ink to become hardened and is firmly adhered to the sheet S, UV light sources 37*a* and 37*b* are provided. With respect to a UV light source, a mercury lamp, a metal halide lamp, an excimer laser lamp, an ultraviolet laser lamp, a cold cathode tube lamp, a thermal cathode tube lamp, a black light lamp, a light emitting diode (LED) lamp or the like can be applied to the UV light source. In addition, this ink hardening process is performed through two divided processes, one being an interim hardening process, the other one being a full hardening process. A UV light source 37*a* for the interim hardening is arrayed between any two adjacent ones of the printing heads 36*a* to 36*d*. That is, the UV light source 37*a* is a light source for hardening an ink to a degree that does not break the shape of the ink (that is, a light source for the interim hardening process) by irradiating the ink with low-intensity ultraviolet light rays, and is not a light source for completely hardening the ink. Meanwhile, a UV light source 37*b* for full hardening is provided at the downstream side of the printing heads 36*a* to 36*d* in the transportation direction Ds. That is, the UV light source 37*b* is a light source for fully hardening an ink (that is, a light source for the full hardening process) by irradiating the ink with ultraviolet light rays whose intensity is higher than that of the ultraviolet light rays radiated from the UV light source 37*a*. With respect to the UV light sources 37*a* and 37*b*, the same kind of light source may be employed or different kinds of light source may be employed. The interim hardening and the full hardening performed in this way enable color images formed by the printing heads 36*a* to 36*d* to firmly adhere to the obverse face of the sheet S.

Moreover, a printing head 36*e* is arranged at the downstream side of the UV light source 37*b* in the transportation direction Ds so as to face the surface of the platen 30. This printing head 36*e* is a printing head for ejecting a transparent ink onto the obverse face of the sheet S by means of the ink jet method, and is configured so as to come close to or spaced from the platen 30. The printing head 36*e* in the state of being close to the platen 30 faces the obverse face of the sheet S being supported by the platen 30 so as to be spaced from the obverse face of the sheet S by a slight clearance for printing, and ejects a transparent ink by means of the ink jet method. In this way, the transparent ink is further ejected onto the color images having been formed by the printing heads 36*a* to 36*d* for four colors. Meanwhile, the printing head 36*e* in the state of being separate from the platen 30 faces the obverse face of the sheet S being supported by the platen 30 so as to be spaced from the obverse face of the sheet S by a clearance for evacuation, the amount of which is larger than that of the clearance for printing, and thus, can be evacuated from the sheet S to which a foreign object is adhered, a foreign object or the like which passes above the platen 30 along the transportation path Pc.

Furthermore, a UV light source 38 is arranged at the downstream side of the printing head 36*e* in the transportation direction Ds. This UV light source 38 is a light source for completely hardening the transparent ink having been ejected by the printing head 36*e* (that is, a light source for the full hardening process) by irradiating the transparent ink with high-intensity ultraviolet light rays. In this way, it is possible to allow the transparent ink to firmly adhere to the obverse face of the sheet S.

As described above, in the processing portion 3, ejections and hardenings of inks are appropriately performed with respect to the sheet S being supported by the platen 30, so that color images coated by the transparent ink are formed. Further, the sheet S on which these color images are formed is transported to the reeling portion 4 by the posterior driving roller 32.

In addition, the full hardening process in this embodiment does not mean not only a process of bringing an ink into a state in which the ink becomes hardened to a degree of 100 percentage, but includes a process of bringing an ink into a state in which the ink becomes hardened to a degree, for example, which does not cause the ink to be in the state of being adhered to the nip roller 32*n* at the time after the sheet S has passed between the nip roller 32*n* and the posterior driving roller 32.

The reeling portion 4 includes a reeling shaft around which an edge of the sheet is wound, and a driven roller 41 on which the sheet in the state of being transported to the reeling shaft 40 is wound and hung. The unreeling shaft 40 supports the sheet S under the state where another edge portion of the sheet S is wound around itself and the obverse face of the sheet S faces in an outward direction from itself. Further, the rotation of the reeling shaft 40 in the clockwise direction on the surface of FIG. 1 causes the sheet S to be wound around the reeling shaft 40 via the driven roller 41.

Figure 2:
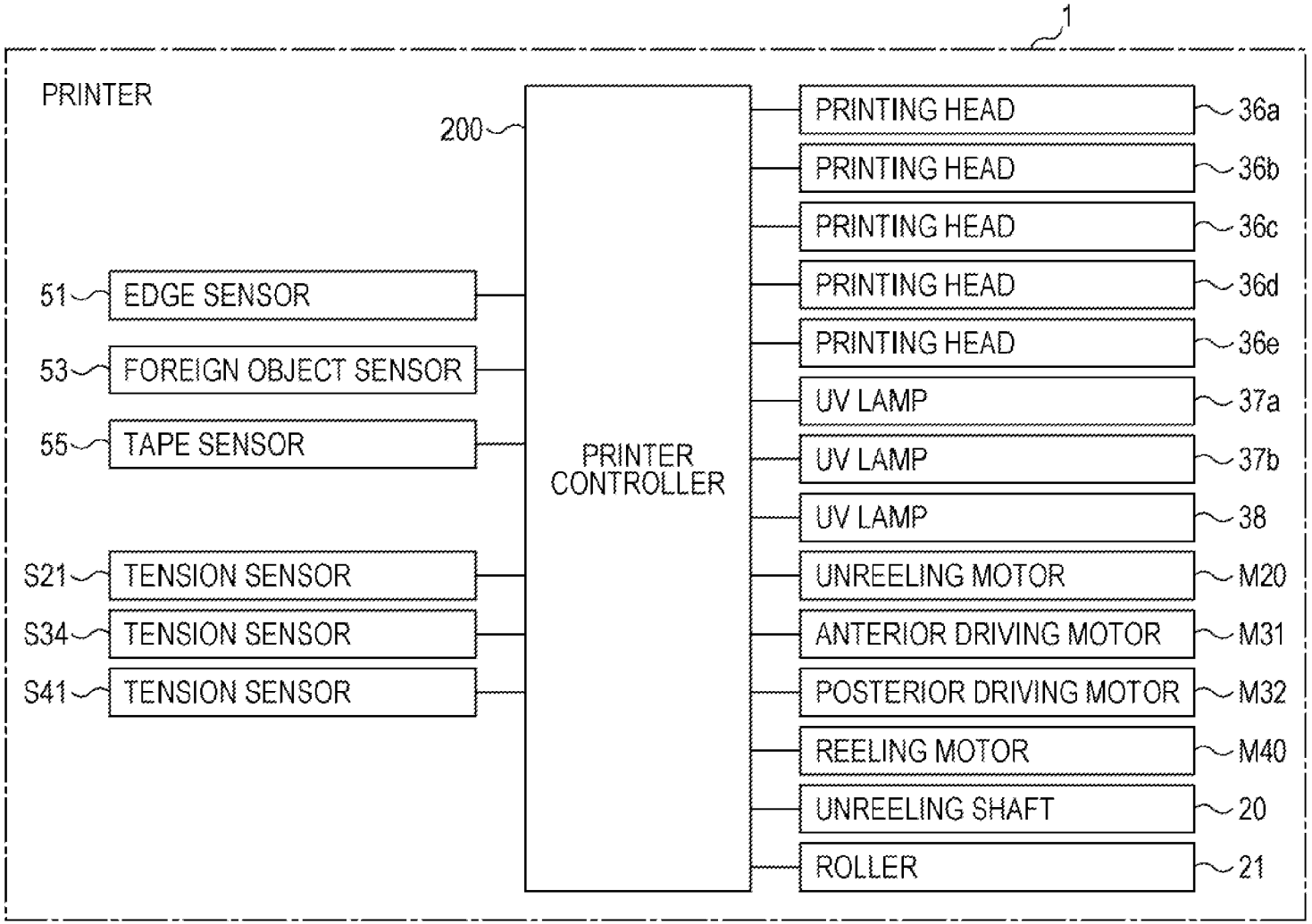
FIG. 2 is a block diagram illustrating an electrical configuration for controlling a printer illustrated in FIG. 1.

The above is an outline of the configuration of the printer 1. Subsequently, an electrical configuration for controlling the printer 1 will be described. FIG. 2 is a schematic block diagram illustrating an electrical configuration for controlling the printer 1 shown in FIG. 1. The printer 1 is provided with a printer controller 200 for controlling individual units of the printer 1 in accordance with instructions from an external host computer or the like. Further, individual device portions including the printing heads, the UV light sources and the portions constituting the sheet transportation system are controlled by the controller 200. The details of control performed by the printer controller 200 with respect to these individual device portions will be described below.

The printer controller 200 fulfills the function of controlling the transportation of the sheet S having been described in detail using FIG. 1. That is, the unreeling shaft 20, the posterior driving roller 31, the anterior driving roller 32, and the reeling shaft 40 among the members constituting the sheet transportation system are each connected to a corresponding one of a plurality of motors. Further, the printer controller 200 performs control of the transportation of the sheet S by rotating these motors, and simultaneously therewith, controlling the speed and the torque of each of the motors. Hereinafter, this transportation control of the sheet S will be described in detail.

The printer controller 200 supplies the anterior driving roller 31 with the sheet S from the unreeling shaft 20 by rotating an unreeling motor M20 for driving the unreeling shaft 20. In this case, the printer controller 200 makes an adjustment of a tension of the sheet S within a range from the unreeling shaft 20 to the anterior driving roller 31 (this tension being referred to as an unreeling tension Ta) by controlling the torque of the unreeling motor M20. That is, a tension sensor S21 for detecting the unreeling tension Ta is attached to the driven roller 21 which is arranged between the unreeling shaft 20 and the anterior driving roller 31. This tension sensor S21 can be realized by using, for example, a load cell which detects stress given by the sheet S. Further, the printer controller 200 makes an adjustment of the unreeling tension Ta of the sheet S by performing feedback control of the torque of the unreeling motor M20 on the basis of the result of a detection made by the tension sensor S21.

In this case, the printer controller 200 unreels the sheet S while adjusting a location of the sheet S in a width direction of the sheet S (i.e., in a direction perpendicular to the surface of FIG. 1) which is supplied from the unreeling shaft 20 to the anterior driving roller 31. Through this adjustment, the unreeling shaft 20 and the driven roller 21 are each position-adjusted in a shaft direction (in other words, in a width direction of the sheet S), and thereby steering is performed with respect to the transportation of the sheet S. Further, an edge sensor 51 for detecting the edges of the sheet S in the width direction of the sheet S is arranged between the driven roller 21 and the anterior driving roller 31. This edge sensor 51 can be realized by using a distance sensor, such as an ultrasonic sensor. Further, the printer controller 200 performs feedback control of the steering on the basis of the result of a detection made by the edge sensor 51. Through this control, it is possible to prevent defects in the transportation of the sheet S, such as meandering of the sheet S.

Further, the printer controller 200 rotates an anterior driving motor M31 for driving the anterior driving roller 31 as well as a posterior driving motor M32 for driving the posterior driving roller 32. This operation causes the sheet S having been unreeled from the unreeling portion 2 to pass through the processing portion 3. In this case, speed control is performed on the anterior driving motor M31; while torque control is performed on the posterior driving motor M32. That is, the printer controller 200 makes an adjustment of the rotation speed of the anterior driving motor M31 such that the rotation speed thereof is kept constant on the basis of an output of an encoder for the anterior driving motor M31. Through this adjustment, the sheet S is transported at a constant speed (for example, 250 [mm/s]) by the anterior driving roller 31.

Meanwhile, the printer controller 200 makes an adjustment of a tension of the sheet S within a range from the anterior driving roller 31 to the posterior driving roller 32 (this tension being referred to as a processing tension Tb) by controlling the torque of the posterior driving motor M32. That is, a tension sensor S34 for detecting the processing tension Tb is attached to the driven roller 34 which is arranged between the platen 30 and the posterior driving roller 32. This tension sensor S34 can be realized by using, for example, a load cell which detects stress given by the sheet S. Further, the printer controller 200 makes an adjustment of the processing tension Tb of the sheet S by performing feedback control of the torque of the posterior driving motor M32 on the basis of the result of a detection made by the tension sensor S34.

Further, the printer controller 200 causes the reeling shaft 40 to wind the sheet S, which is transported by the posterior driving roller 32, around the reeling shaft 40 itself by rotating the reeling motor M40 for driving the reeling shaft 40. In this case, the printer controller 200 makes an adjustment of a tension of the sheet S with in a range from the posterior driving roller 32 to the reeling shaft 40 (this tension being referred to as a reeling tension Tc) by controlling the torque of the reeling motor M40. That is, a tension sensor S41 for detecting the reeling tension Tc is attached to the driven roller 41 which is arranged between the posterior driving roller 32 and the reeling shaft 40. This tension sensor S41 can be realized by using, for example, a load cell which detects stress given by the sheet S. Further, the printer controller 200 makes an adjustment of the reeling tension Tc of the sheet S by performing feedback control of the torque of the reeling motor M40 on the basis of the result of a detection made by the tension sensor S41.

Moreover, the printer controller 200 performs control of operation of the printing heads 36*a* to 36*e* and the UV light sources 37*a*, 37*b* and 38 in accordance with a transportation situation of the sheet S on the platen 30. That is, the transportation situation of the sheet S on the platen 30 can be grasped from, for example, an output value of the encoder for the anterior driving motor M31. Thus, the printer controller 200 generates a synchronization signal synchronized with the transportation of the sheet S from the output value of this encoder, and the like, and performs control of the printing heads 36*a* to 36*e* and the UV light sources 37*a*, 37*b* and 38 on the basis of this synchronization signal.

Specifically, ink ejection timing of each of the printing heads 36*a* to 36*d* is controlled on the basis of the synchronization signal. This control allows an ink ejected from each of the printing heads 36*a* to 36*d* to be landed onto a target position of the sheet S in the state of being transported, and thereby enables formation of color images each having suitable color tone. Further, timing at which the printing head 36*e* ejects the transparent ink is similarly controlled on the basis of the synchronization signal. This control makes it possible to allow the transparent ink to be accurately ejected onto the color images having been formed by the plurality of printing heads 36*a* to 36*d*. Further, timing points of turning on and off and a radiation light amount of each of the UV light sources 37*a*, 37*b* and 38 are also controlled by the printer controller 200.

Moreover, the printer controller 200 performs control of operation of the printing heads 36*a* to 36*e* and the UV light sources 37*a*, 37*b* and 38 on the basis of the result of a detection made by each of a foreign object sensor 53 and a tape sensor 55. The foreign object sensor 53 is a sensor for detecting the thickness of a foreign object adhered to the obverse sheet S, and is arranged at the upstream side of the platen 30 on the transportation path Pc so as to face the sheet S. Thus, it is possible to recognize the presence of a foreign object adhered to the obverse face of a certain portion of the sheet S before the certain portion of the sheet S reaches the platen 30. Further, when having determined that there is a possibility that the foreign object is contacted with the printing heads 36*a* to 36*e*, on the basis of the result of a comparison of the thickness of the foreign object with an amount of the clearance for printing, the printer controller 200 takes appropriate action, such as a halt of the transportation of the sheet S or evacuation of the printing heads 36*a* to 36*e*.

The tape sensor 55 is a sensor for detecting each of pieces of joint tape on the sheet S, and is arranged at the upstream side of the platen 30 on the transportation path Pc (specifically, the tape sensor 55 being arranged between the anterior roller 31 and the driven roller 33). The tape sensor 55 is provided at each of the obverse face and the reverse face of the sheet S. Further, each of the tape sensors 55 is configured to, when having detected a piece of joint tape adhered to a corresponding one of the faces of the sheet S, output a detection signal. Further, in this embodiment, predetermined control is performed on the basis of the result of a detection made by each of the tape sensors 55. In the following, the content of this predetermined control will be described in detail.

Figure 3:
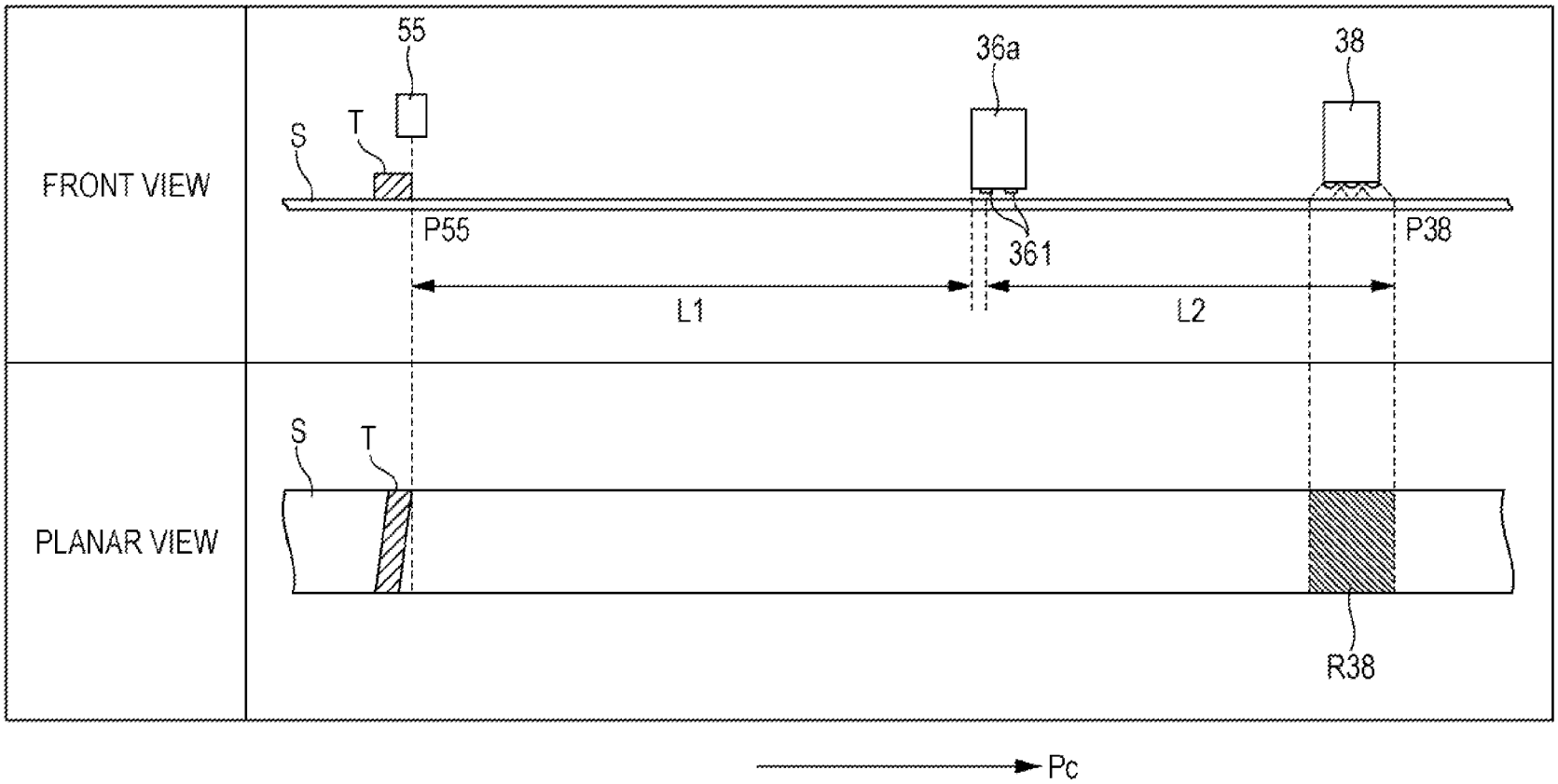
FIG. 3 is a diagram illustrating location relations among a tape sensor, printing heads and UV light sources according to an embodiment of the invention.

First, detailed location relations among individual portions of the printer 1 which are targeted for control based on the result of a detection made by the tape sensor 55 will be described with reference to FIG. 3. Here, FIG. 3 is a schematic diagram illustrating a condition where location relations among the printing heads and the UV light sources are expanded along a sheet transportation path. In FIG. 3, an upper portion illustrates a condition from a front view, and a lower portion illustrates a condition from a planar view. In particular, in the upper portion of FIG. 3, distance relations along the transportation path Pc among a piece of joint tape T, a detection position P55 of the tape sensor 35, the printing head 36*a* and the UV light source 38 are illustrated, and in the lower portion of FIG. 3, distance relations along the transportation path Pc among the piece of joint tape T, the detection position P55 of the tape sensor 35 and a radiation area R38 of the UV light source 38 are illustrated.

As shown in FIG. 3, when having detected that the piece of joint tape T has reached the detection position P55, the tape sensor 55 outputs a detection signal. With respect to a specific configuration of the tape sensor, one of various sensors, such as a color sensor and a distance sensor, can be employed. In particular, in the case where the piece of joint tape T has a color different from that of the obverse face of the sheet S, the color sensor can be employed as a suitable tape sensor. The detection position P55 of the tape sensor 55 can be obtained as a position of the downstream side of the piece of joint tape T on the transportation path Pc, at the time when the detection signal has been outputted from the tape sensor 55. Incidentally, as described above, the tape sensor 55 may be provided at each of the obverse face and the reverse face of the sheet S. In this case, the detection positions P55 of the respective tape sensors 55 may correspond to each other or may be different from each other.

The UV light source 38 irradiates the predetermined radiation area R38 on the obverse face of the sheet S with ultraviolet light rays for full hardening. The downstream side edge of the radiation area R38 on the transportation path Pc can be obtained as a position at which, in a profile of the intensity of the ultraviolet rays for the radiation area R38, the intensity of the ultraviolet rays becomes 50 percentage of a maximum intensity thereof, or a position at which the ink becomes fully hardened.

Further, with respect to the printing head 36*a*, which is located at the most upstream side on the transportation path Pc among the plurality of printing heads 36*a* to 36*e*, the detection position P55 and a downstream side edge P38 of the radiation area R38 satisfy a distance relation given by the following expression: distance L1>distance L2. Here, the distance L1 is a distance along the transportation path Pc, from the detection position P55 to an upstream side edge of the printing head 36*a* on the transportation path Pc, and the distance L2 is a distance along the transportation path Pc, from a most upstream side nozzle (nozzle row) 361 of the printing head 36*a* on the transportation path Pc to the downstream side edge P38 of the radiation area R38.

Figure 4:
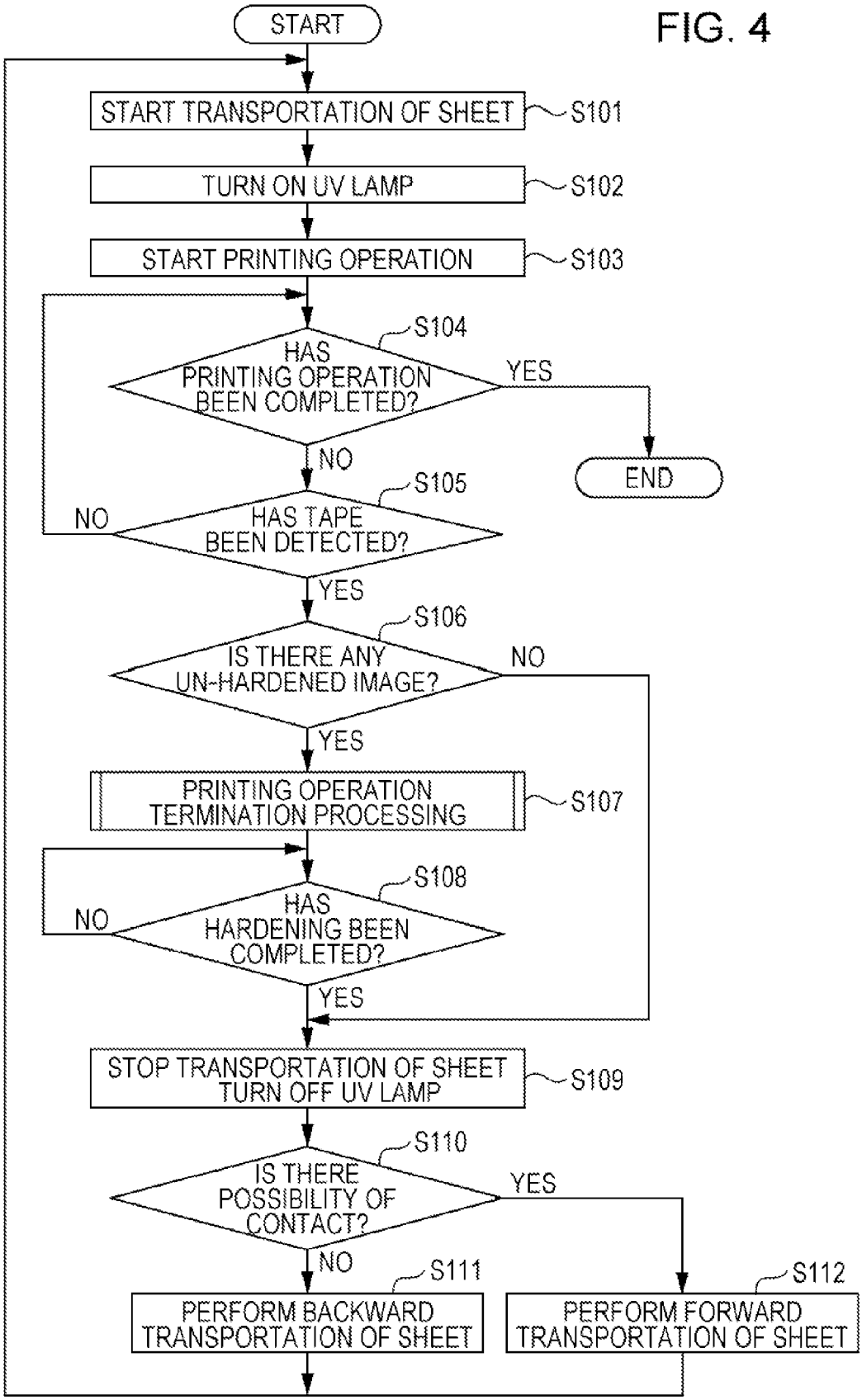
FIG. 4 is a flowchart illustrating an example of operation performed by a printer according to an embodiment of the invention.
Figure 5:
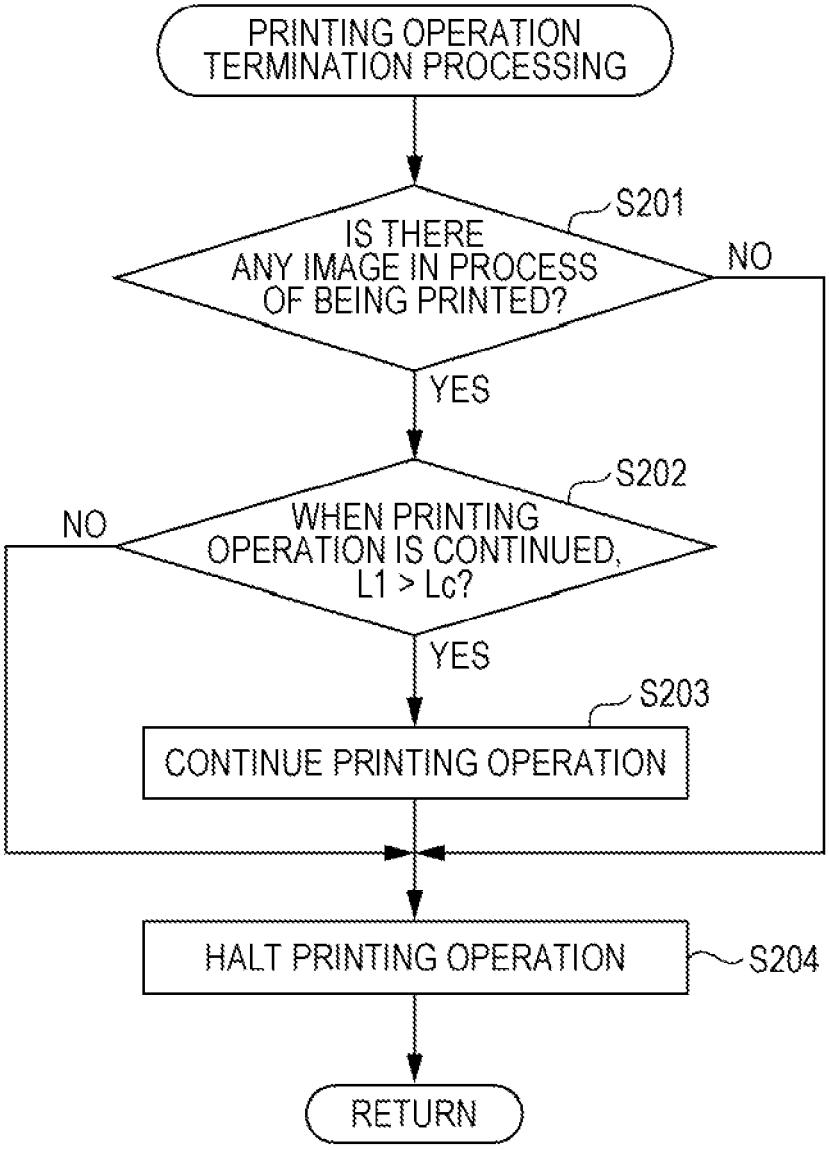
FIG. 5 is a flowchart illustrating an example of the content of image recording processing indicated in FIG. 4.
Figure 6:
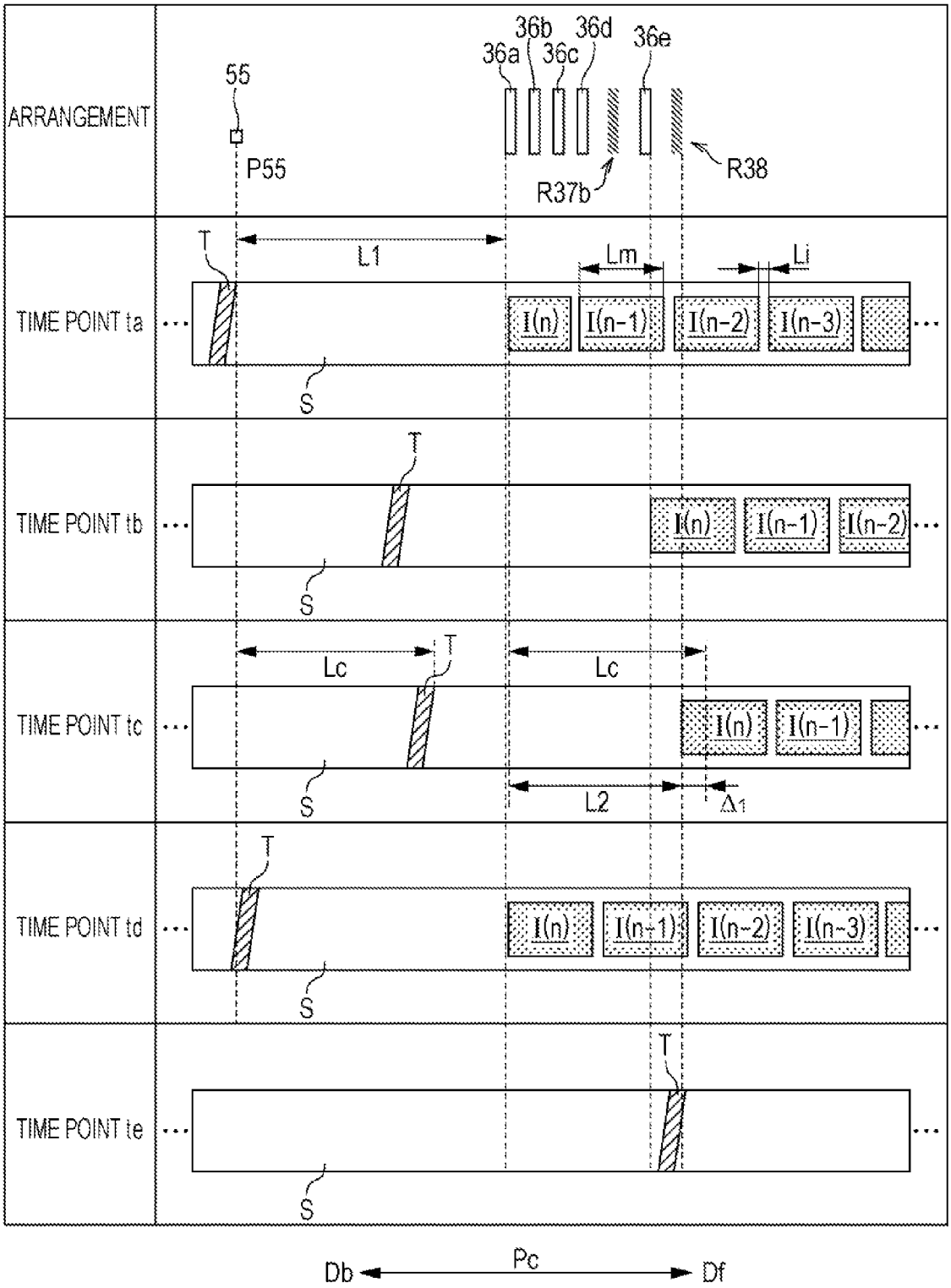
FIG. 6 is a schematic diagram illustrating a condition of operation performed in accordance with a flowchart of FIG. 4.

Subsequently, a specific example of operation of control based on the basis of the result of a detection made by the tape sensor 55 will be described with reference to FIGS. 4 to 6. Here, FIG. 4 is a flowchart illustrating an example of operation performed in the printer 1; FIG. 5 is a flowchart illustrating an example of the content of image recording processing shown in FIG. 4; and FIG. 6 is a schematic diagram illustrating a condition of operation performed in accordance with the flowchart of FIG. 4. In FIG. 6, there is illustrated a condition which is expanded along the transportation direction Pc. In particular, in a field of "arrangement", there are illustrated location relations in the transportation direction Pc among the detection position P55 of the tape sensor 55, the printing heads 36*a* to 36*e*, a radiation area R37*b* of the UV light source 37*b* for full hardening and the radiation area R38 of the UV light source 38 for full hardening; and in each of fields from "time point ta" to "time point to", there is illustrated a condition of recording operation at a corresponding time point. Further, in order to identify a plurality of images I, each of the images I appends its formation order denoted within parentheses, such as (n−3), (n−2), . . . , and (n).

When the printer controller 200 starts a process flow of the flowchart shown in FIG. 4, in step S101, the motors M20, M31, M32 and M40 each operate, so that the transportation of the sheet S starts, and in subsequent step 102, the UV light sources 37*a*, 37*b* and 38 are turned on. When the sheet transportation and the light source lighting have been each in a stable state, in step S103, printing operation is started. This printing operation is operation for printing images on the sheet S by electing inks from the printing heads 36*a* to 36*e* onto the sheet S in the state of being transported along the transportation path Pc, and corresponds to the "recording operation" in the first aspect of the invention. As shown in FIG. 6, in this printing operation, the plurality of images I is sequentially formed along the transportation path Pc. Each of these images I has a length Lm along the transportation path Pc, and is arranged at intervals of a distance Li along the transportation path Pc.

In step S104, it is determined whether or not all images for which printing has been instructed by job data have been completely printed, and printing operation is to be terminated. When the determination result is "YES" in step S104, the process flow of the flowchart of FIG. 4 is terminated; while, when the determination result is "NO" in step S104, the process flow proceeds to step S105. In step S105, it is determined whether or not the tape sensor 55 has detected that a piece of joint tape has reached the detection position P55. When the tape sensor 55 has not yet detected that the piece of joint tape has reached the detection position P55 (in the case of "NO" in step S105), the process flow returns to step S104. In contrast, as shown in a field "time point ta" of FIG. 6, when the tape sensor 55 has detected that the piece of joint tape T has reached the detection position P55 (in the case of "YES" in step S105), processing of subsequent step S106 is carried out. In addition, in this flowchart, for the sake of convenience, the process flow proceeds to step S105 after the determination "NO" in step S104, but, actually, the determination as to whether or not the tape sensor has detected that the piece of joint tape has reached the detection position P55 is started simultaneously with the start of the sheet transportation in step S101.

In step S106, it is determined whether or not, at a detection time point ta when the piece of joint tape T has been detected, there is any un-hardened image which is not yet subjected to a full hardening process in the radiation range R38 among the images I having been already printed on the sheet S. Further, in the case where there is no un-hardened image I (in the case of "NO" in step S106), the process flow proceeds to step S109, and the transportation of the sheet S is brought to a stop. In contrast, in the case where there is any un-hardened image (in the case of "YES" in step S106), printing operation termination processing of step S107 is carried out. In the operation example shown in FIG. 6, part of an image I(n−2), an image I(n−1) and an image I(n) are not yet hardened at the detection time point ta, and thus, processing of step 107 is carried out.

The printing operation termination processing of step S107 is performed by carrying out pieces of processing of steps S201 to S204 of FIG. 5. In step S201, it is determined whether or not, at the detection time point ta, there is any image I in process of being printed. Further, in the case where there is no image I in process of being printed (in the case of "NO" in step S201), the process flow proceeds to step S204, and ink ejections from the printing heads 36*a* to 36*e* are each brought to a stop, and the printing operation is terminated. In contrast, there is any image I in process of being printed (in the case of "YES" in step S201), the process flow proceeds to step S202. In step S202, it is determined whether or not, when the printing operation is brought to a halt after printing of the image I in process of being printed at the detection time point ta has been completed, the distance L1 becomes longer than a transportation distance Lc of the sheet S during a period from the detection time point ta until a transportation stop time point tc described below. Further, in the case where it has been determined that the distance L1 becomes longer than the transportation distance Lc (in the case of "YES" in step S202), the printing operation is continuously performed in step S203, and is brought to a halt after printing of the image I in process of being printed has been completed. In contrast, in the case where it has been determined that the distance L1 becomes equal to or shorter than the transportation distance Lc (in the case of "NO" in step S202), the process flow proceeds to step S204, and the printing operation is brought to a halt before a time point at which the printing operation is brought to a stop in the case where the distance L1 becomes equal to the transportation distance Lc (for example, simultaneously with the detection of the piece of joint tape T).

In the operation example shown in FIG. 6, at the detection time point ta, the image I(n) and part of the image I(n−1) are in process of being printing, and L1>Lc, and thus, processing of step S203 is carried out. Specifically, in step S203, the printing processing is continuously performed until printing of the images I(n−1) and I(n) which were in process of being printed has been completed. As shown in a field "time point tb" of FIG. 6, when the printing of the images I(n−1) and I(n) has been completed at a printing halt time point tb (a recording halt time point), the process flow proceeds to step S204, the ink ejections from the printing heads 36*a* to 36*e* are each brought to a stop, and the printing operation is brought to a halt. Further, the process flow returns to the flowchart of FIG. 4.

In step S108, the transportation operation of transporting the sheet S is continuously performed and, concurrently therewith, it is verified whether or not hardening of all the images I having been printed on the sheet S has been completed. Further, when the image I(n) existing at the most upstream side of the transportation path Pc among the plurality of images I has passed through the downstream side edge of the radiation area R38, that is, when hardening of all the images I has been completed, the determination in step S108 results in "YES"; the transportation of the sheet S is brought to a stop; and further, the UV light sources 37*a*, 37*b* and 38 are turned off (step S109). Describing in more detail, the transportation of the sheet S is brought to a stop, simultaneously with turning off of the UV light sources 37*a*, 37*b* and 38, or after the turning off of the UV light sources 37*a*, 37*b* and 38.

In a field "time point tc" of FIG. 6, there is illustrated a condition at a transportation stop time point tc when the transportation of the sheet S is brought to a stop. During a period from the detection time point to until the transportation stop time point tc, operation is performed such that a remaining color image Δ1 of the image I(n) which was in process of being printed is additionally formed, and further, the completed image I(n) is caused to pass through the radiation area R38 by being transported by a distance L2. In this case, the transportation distance Lc of the sheet S during a period from the time point ta until the time point tc results in a distance obtained by adding the distance L2 to the length Δ1 of the additionally formed image I along the transportation path Pc (i.e., Lc=L2+Δ1)

In this embodiment, configuration is made such that the piece of joint tape T, which moves from the detection position P55 to the downstream side on the transportation path Pc by the distance Lc during a period from the time point ta until the time point tc, does not reach the most upstream side printing head 36*a*. Specifically, the tape sensor 55 is arranged at a position which allows the distance L1 from the detection position P55 to the most upstream side printing head 36*a* to be longer than the transportation distance Lc of the sheet S during a period from the time point ta until the time point tc (i.e., L1>Lc=L2+Δ1). Thus, as a result, at the transportation stop time point tc, the piece of joint tape T stops at the upstream side of the most upstream side printing head 36*a* on the transportation path Pc.

Describing in more detail, the length Δ1 of the additionally formed image I varies within a range less than a maximum value Lmax of the length Lm of the image I along the transportation path Pc, and the transportation distance Lc also varies within this range. Thus, in order to complete printing of the images I which were in process of being printed at the detection time point to and, simultaneously therewith, cause the piece of joint tape T to certainly stop before reaching the printing head 36*a*, the tape sensor 55 should be arranged such that the distance L1 becomes longer than a distance resulting from adding the distance Lmax to the distance L2 (i.e., L1>L2+Lmax).

In Step S110, it is predicted whether or not, when the transportation of the sheet S is resumed, there occurs a contact between a portion of the sheet S where the piece of joint tape T is provided and the printing heads 36*a* to 36*e*. Specifically, when the piece of joint tape T has passed by the foreign object sensor 53 along the transportation path Pc, the thickness of the piece of joint tape T is detected by the foreign object sensor 53. Further, from the result of a comparison of the thickness of the piece of joint tape T with an amount of the clearance for printing, it is predicted whether or not there occurs a contact between the portion of the sheet S where the piece of joint tape T is provided and the printing heads 36*a* to 36*e*.

Further, when it is predicted that there occurs no contact (in the case of "NO" in step S110), the process flow proceeds to step S111, and backward transportation of the sheet S is carried out. Specifically, in step S111, the sheet S is transported in a backward direction Db (a direction reverse to the transportation direction Ds) on the transportation path Pc by a backward transportation distance. This backward transportation distance is set to a distance larger than or equal to a transportation distance of the sheet S during a period from the printing halt time point tb when the printing operation was brought to a halt until the transportation stop time point tc when the sheet transportation was brought to a stop. Through performing such a backward transportation, a position at which forming of the images is started in resumed printing operation can be located near the printing head 36*a* (that is, cueing can be performed). In this way, a distance between the images I having been completely formed on the sheet S and the images to be formed in resumed printing operation can be reduced, so that it is possible to save wasteful consumption of the sheet S. Further, a reason why the backward transportation distance is set to a distance larger than or equal to a transportation distance of the sheet S during a period from the printing halt time point tb when the printing operation was brought to a halt until the transportation stop time point tc when the sheet transportation was brought to a stop is that, when a position at which forming of images is started in resumed printing operation has faced the printing head 36*a*, a state of the transportation of the sheet S needs to be stable, and thus, a running up distance is necessary to make the state of the transportation of the sheet S stable. In addition, in a field "time point td" of FIG. 6, there is illustrated a condition at the time when the backward transportation of the sheet S has been completed.

In contrast, in the case where it is predicted that there occurs a contact (in the case of "YES" in step S110), the process flow proceeds to step S112, and forward transportation of the sheet S is performed. Specifically, in step S112, the printing heads 36*a* to 36*e* are caused to be located spaced from the transportation path Pc, and then, the piece of joint tape T is caused to move from the upstream side to the downstream side of the printing heads 36*a* to 36*e* along the transportation path Pc in conjunction with the transportation of the sheet S in a forward direction Df (which corresponds to the transportation direction Ds). Through this operation, it is possible to prevent contact of the portion where the piece of joint tape T is provided with the printing heads 36*a* to 36*e* and, simultaneously therewith, resume the printing operation. In addition, in a field "time point te" of FIG. 6, there is illustrated a condition at the time when the transportation of the sheet S has been completed.

When processing of step S111 or step S112 has been completed, the process flow returns to step S101, and the transportation of the sheet S is started. Moreover, the UV light sources 37*a*, 37*b* and 38 are turned on (step S102), and further, the printing operation is resumed (step S103). In addition, in the case where it is predicted that there occurs no contact, in resumed printing operation, printing of the images I may be performed onto a portion where the piece of joint tape T is provided, or printing of the images I may be performed so as to avoid the relevant portion.

As described above, in this embodiment, the printer controller 200 handles a unit constituted of the printing heads 36*a* to 36*e* as a printing unit 36 (corresponding to the "recording unit" in the first aspect of the invention), and performs control according to the aspect of the invention. That is, printing operation of recording the images I on the sheet S by ejecting inks from the printing heads 36*a* to 36*e* onto the sheet S in the state of being transported along the transportation path Pc is performed by using the printing unit 36U. Further, the UV light source 38 (the light radiation portion) is provided at the downstream side of the printing unit 36U on the transportation path Pc, and the inks having been ejected on the sheet S become hardened by being irradiated with ultraviolet light rays from the UV light source 38. In this way, the images I are firmly adhered to the sheet S.

The detection position P55 for detecting the piece of joint tape T (the joint member) is provided at the upstream side of the printing unit 36U on the transportation path Pc, and when it has been detected that the piece of joint tape T has reached the detection position P55 (at the time point ta), the printing operation is brought to a halt (at the time point tb, and tb>ta). Meanwhile, the transportation of the sheet S is continued for a while even after the printing halt time point tb, and at least hardening of inks which are already ejected on the sheet S at the printing halt time point tb is completed by the UV light source 38. This makes it possible to prevent that un-hardened images I are left as they are after the halt of the transportation of the sheet S, and other component members are soiled thereby.

In this regard, nevertheless, in such a configuration, the transportation of the sheet S is continued even after the detection time point ta at which the piece of joint tape T has reached the detection position P55, and thus, a portion where the piece of joint tape T is provided moves in conjunction with the transportation of the sheet S and is likely to be contacted with the printing heads 36*a* to 36*e*. In order to avoid this situation, in this embodiment, the detection position P55 is provided such that the distance L1 from the detection position P55 to the printing unit 36U (the most upstream side printing head 36*a*) along the transportation path Pc becomes longer than the distance Lc of the transportation of the sheet S during a period from the detection time point ta until the transportation stop time point tc. Thus, it is possible to complete an operation of bringing the transportation of the sheet S to a stop after the completion of hardening of inks which are already ejected on the sheet S before the piece of joint tape has reached the printing unit 36U, so that it is prevented that the portion where the piece of joint tape is provided is contacted with the printing heads 36*a* to 36*e*. In this way, in this embodiment, it is possible to prevent both disadvantages, one being that the portion where the piece of joint tape is provided is contacted with the recording heads 36*a* to 36*e*, the other one being that un-hardened images are left as they are.

Further, in this embodiment, in the case where, at the detection time point ta, there exists at least one of the images I which is in process of being printed, and further, L1>Lc, printing operation is brought to a halt after the completion of printing of the at least one image I in process of being printed. This configuration makes it possible to prevent formation of incomplete images on the sheet S, and thus, leads to an advantage in that wasteful consumption of the sheet S because of the incomplete images does occur anymore.

Further, in this embodiment, it is possible to, from the result of a detection made by the foreign object detection sensor 53, predict whether or not, when the piece of joint tape T passes below the printing heads 36*a* to 36*e* along the transportation path Pc, there occurs a contact between a portion where the piece of joint tape T is provided and the printing heads 36*a* to 36*e*. Further, the resumption of the printing operation after the transportation stop time point tc is controlled on the basis of this prediction result. This configuration makes it possible to resume the printing operation in a suitable way in accordance with the thickness of the piece of joint tape T.

As described above, in this embodiment, the printer 1 corresponds to the "image recording device" in the first aspect of the invention; the unreeling portion 2, the reeling portion 4 and other rollers 21, 31, 33, 34 and 43 cooperatively function as the "transportation portion" in the first aspect of the invention; the printing unit 36U corresponds to the "recording unit" in the first aspect of the invention; the printing heads 36*a* to 36*e* correspond to the "recording head" in the first aspect of the invention; the UV light source 38 corresponds to the "light radiation portion" in the first aspect of the invention; the tape sensor 55 corresponds to the "position detection portion" in the first aspect of the invention; the head controller 200 corresponds to the "controller" in the first aspect of the invention; and the foreign object sensor 53 corresponds to the "thickness detection portion" in the first aspect of the invention. Further, the distance L2 corresponds to the "first distance" in the first aspect of the invention; the distance L1 corresponds to the "second distance" in the first aspect of the invention; and the distance Lc corresponds to the "third distance" in the first aspect of the invention.

It is to be noted here that the invention is not limited to the aforementioned embodiment, and various changes can be made on the aforementioned embodiment within a scope not departed from the gist of the invention. For example, timing when printing operation is brought to a halt may be changed from the above-described timing. Specifically, the printing operation may be brought to a halt at the same time as the detection time point ta (i.e., ta=Tb). In such a case, there is no image to be additionally formed after the detection time point ta (that is, $\Delta 1=0$), and thus, the transportation distance Lc of the sheet S during a period from the detection time point ta until the transportation stop time point tc becomes equal to the distance L2. Accordingly, in the case where the tape sensor 55 is arranged such that the distance L1 becomes larger than the distance L2 (i.e., L1>L2), it is possible to prevent both the disadvantages, one being that the portion where the piece of joint tape is provided is contacted with the printing heads 36*a* to 36*e*, the other one being that un-hardened images are left as they are.

Figure 7:
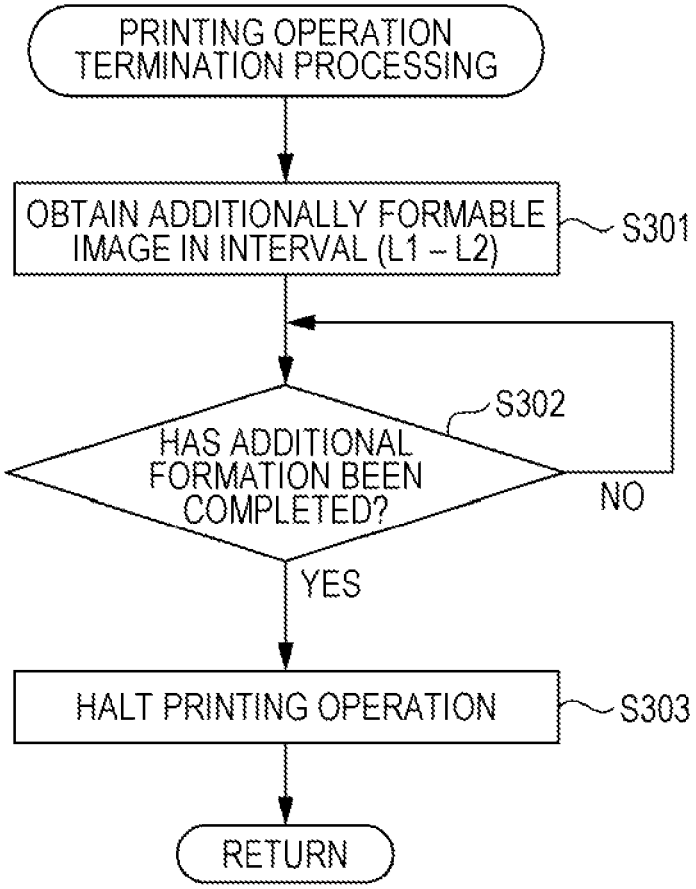
FIG. 7 is a flowchart illustrating a modification example of the content of image recording processing illustrated in FIG. 4.

Alternatively, configuration may be made such that printing operation is terminated at timing shown in FIG. 7. Here, FIG. 7 is a flowchart illustrating a modification example of the content of image recording processing shown in FIG. 4. In the state of the detection time point ta of FIG. 6, the transportation distance Lc during a period from the detection time point ta until the transportation halt time point tc is a distance resulting from adding the length of an additionally formed image to the length L2 (i.e., $Lc=L2+\Delta 2$). In addition, this $\Delta 2$ indicates not only the length of the remaining color image $\Delta 1$ of the image I(n) in process of being printed below the printing head 36*a* at the detection time point ta, but the $\Delta 2$ also includes the lengths of an image I(n+1) and subsequent images I, which are not yet formed. Further, under the condition where the transportation distance Lc is shorter than the distance L1 (i.e., Lc<L1), at the transportation stop time point tc, the piece of joint tape T is brought to a stop before the printing unit 36U. Thus, a condition to be satisfied by the length $\Delta 2$ is as follows:

$\Delta 2 < L1 - L2$

In other words, within a range which satisfies this condition, it is possible to additionally form images I after the detection time point ta.

Thus, in a modification example shown in FIG. 7, in step S301, images which can be additionally formed within an interval (=L1−L2) are obtained, and printing operation is continued after the detection time point ta. Further, in step S302, it is determined whether or not the formation of the images, which have been determined to be able to be additionally formed in step S301, has been completed. Further, when the completion of the formation of all the images to be printed has been confirmed (in the case of "YES" in step S302), in step S303, the printing operation is brought to a halt. In this configuration, the condition that the distance L1 is longer than the transportation distance L1 is also satisfied, it is possible to prevent both the disadvantages, one being that a portion where the piece of joint tape T is provided is contacted with the printing heads 36*a* to 36*e*, the other one being that un-hardened images are left as they are.

Further, it is possible to appropriately change the timing when the transportation of the sheet S is brought to a stop. That is, in the aforementioned embodiment, the transportation of the sheet S is brought to a stop at the time the hardening of all the images I has been completed. Nevertheless, configuration may be made such that, even after the completion of hardening of all the images I, the transportation of the sheet S is continued up to immediately before the printing head 36*a*.

Further, in the aforementioned embodiment, in step S110, in the case where it is predicted that there occurs no contact, the backward transportation is performed. However, this backward transportation may be omitted.

Figure 8:
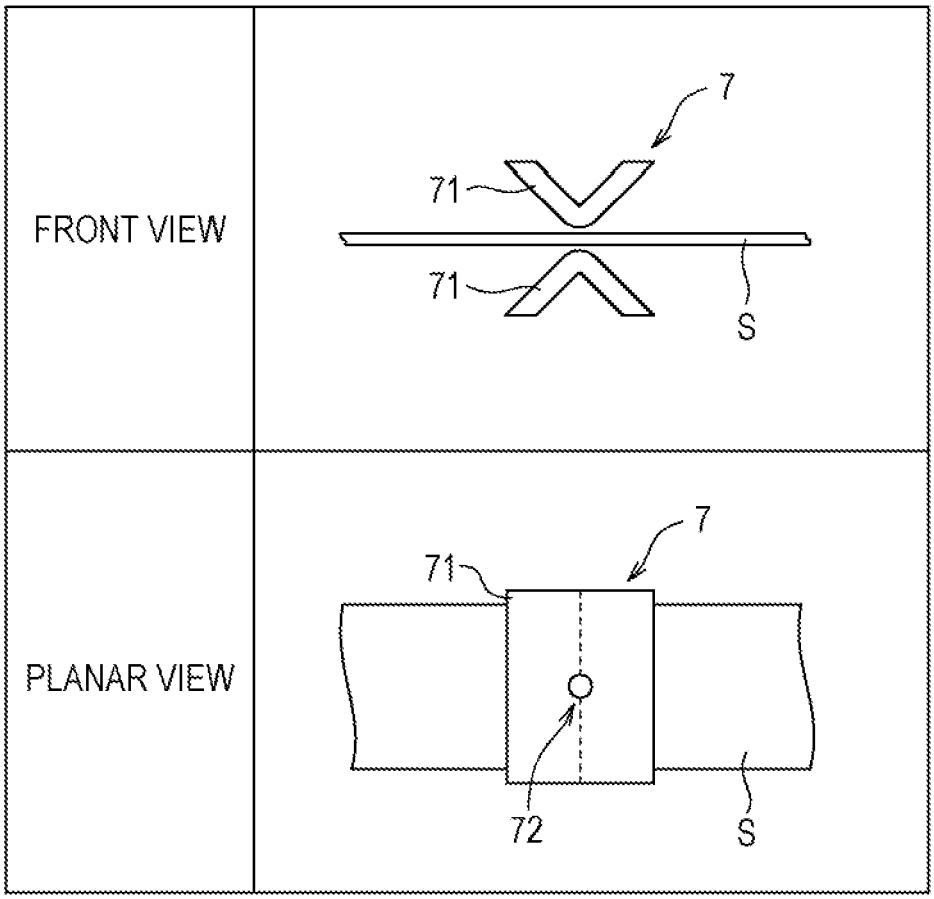
FIG. 8 is a schematic diagram illustrating an example of the structure of a guide mechanism for a sheet, according to an example of the invention.

Further, it is also possible to add appropriate components other than those described above to the printer 1 as needed. Thus, in order to improve detection accuracy with respect to the tape sensor 55, a guide mechanism or the like for suppressing the fluctuation of the sheet S may be provided. FIG. 8 is a schematic diagram illustrating an example of the configuration of a guide mechanism for a sheet. Further, in FIG. 8, an upper portion illustrates a condition from a front view, and a lower portion illustrates a condition from a planar view. The guide mechanism 7 is a mechanism for suppressing the fluctuation of the sheet S by causing bending members 71, each provided for a corresponding one of the obverse and reverse faces of the sheet S, to pinch the sheet S. Specifically, the bending member 71 is caused to bend to a substantially right angle, and a ridge line portion thereof faces the sheet S. Further, an opening of a detection window 72 is provided at the ridge line portion of each of the bending members 71, and each of the tape sensors 55 faces the sheet S through this detection window 72. This mechanism makes it possible for each of the tape sensors 55 to detect the sheet S, the fluctuation of which is suppressed by the guide mechanism 7.

In the aforementioned embodiment, printing operation is performed by using the printing head 36*e* for ejecting a transparent ink. Nevertheless, when the transparent ink is not needed, it is also possible to perform the printing operation without the printing head 36*e*. In such a case, the printing unit 36U constituted of the printing heads 36*a* to 36*d* for ejecting color inks may be handled as the "recording unit" in the first aspect of the invention, and the UV light source 37*b* may be allowed to function as the "light radiation portion" in the first aspect of the invention.

Further, it is also possible to make a change, such as increase or decrease of the number of the printing heads 36*a* to 36*e*. Thus, it is possible to apply the invention to the printer 1 which does not use any transparent ink, and it is also possible to apply the invention to the printer 1 which performs only black-and-white printing.

Further, it is also possible to change the configuration of the UV light sources 37*a*, 37*b* and 38 as needed. Thus, it is also possible to make a change, such as increase or decrease of the number of the UV light sources 37*a*, 37*b* and 38, or deletion of part of the UV light sources 37*a*, 37*b* and 38.

Further, a joint member for connecting media constituting the sheet S is not limited to the aforementioned piece of joint tape T. That is, any member capable of making the sheet S a long-length object by joining media in series can be employed as the joint member.

It is also possible to change a specific configuration, such as a shape of the platen 30, as needed.

What is claimed is:

1. An image recording device comprising:

a transportation portion that transports a continuous medium along a transportation path, the continuous medium being formed by means of jointing a plurality of media with at least one joint member;

a recording unit that includes a recording head facing the transportation path, and carries out recording operation of recording an image on the continuous medium by ejecting a photocurable liquid from the recording unit onto the continuous medium in a state of being transported along the transportation path;

a light radiation portion that is arranged at a downstream side of the recording unit on the transportation path and hardens the liquid which is ejected on the continuous medium; and a position detection portion that detects an arrival of each of the at least one joint member at a detection position which is located at an upstream side of the recording unit on the transportation path, wherein the position detection portion, the recording head and the light radiation portion are arranged along the transportation path such that a second distance, which is a distance from the detection position to the recording head along the transportation path, becomes longer than a first distance, which is a distance from the recording head to the light radiation portion along the transportation path.

2. The image recording device according to claim 1, wherein the light radiation portion is a light source for a full hardening of the liquid which is ejected on the continuous medium.

3. The image recording device according to claim 1, wherein the recording unit has a plurality of the recording heads along the transportation path, and the second distance is a distance from the detection position to one of the plurality of the recording heads which is located at the most upstream side on the transportation path.

4. The image recording device according to claim 1, wherein the light radiation portion has a plurality of UV light sources along the transportation path, and the first distance is a distance from the recording head to one of the plurality of the UV light sources which is located at the most downstream side on the transportation path.

* * * * *